US005381141A

United States Patent [19]

Stahl

[11] Patent Number: 5,381,141

[45] Date of Patent: Jan. 10, 1995

[54] METHOD AND APPARATUS FOR WARNING OTHER BOATS IN THE PROXIMITY OF A WATER CRAFT FOR TOWING WATER SKIERS AND OTHER PERSONS TO BE TOWED THAT THE WATER SKIER IS DOWN OR THE PERSON IS INACTIVE IN THE WATER

[75] Inventor: Wayne L. Stahl, Indian River, Mich.

[73] Assignee: Technological Safety Designs, Inc., Indian River, Mich.

[21] Appl. No.: 125,026

[22] Filed: Sep. 21, 1993

[51] Int. Cl.[6] ..... G08B 23/00

[52] U.S. Cl. ..... 340/984; 116/173; 441/69

[58] Field of Search ..... 340/984, 573; 441/69, 441/68, 89; 114/253; 116/173

[56] References Cited

U.S. PATENT DOCUMENTS

| | | | |
|---|---|---|---|
| 2,627,181 | 2/1953 | Kiekhaefer . | |
| 3,489,912 | 1/1970 | Hoffman, Jr. . | |
| 3,602,188 | 8/1971 | Penaflor | 116/173 |
| 3,652,868 | 3/1972 | Hunt . | |
| 3,798,631 | 3/1974 | Langford | 441/69 |
| 3,948,202 | 4/1976 | Yoshikawa . | |
| 4,134,112 | 1/1979 | Kercheval et al. . | |
| 4,235,181 | 11/1980 | Stickney . | |
| 4,624,141 | 11/1986 | Soleau | 340/984 |
| 4,782,784 | 11/1988 | Little | 441/69 |
| 4,914,946 | 4/1990 | Nakamura et al. | 340/984 |
| 5,003,906 | 4/1991 | Sova . | |
| 5,280,270 | 1/1994 | Correa et al. | 340/984 |

*Primary Examiner*—Brent Swarthout
*Attorney, Agent, or Firm*—Learman & McCulloch

[57] ABSTRACT

A method and apparatus for warning boats in the proximity of a towing water craft that a water skier is down or the person being towed is in a vulnerable position via an electrically activated, high intensity signal visual to boats in the vicinity which is connected to the electrical system for energizing the craft and to a pressure sensitive speedometer including an inlet tube, the speedometer being responsive to fluid pressure in the tube created by movement of the craft through the water, and there being a pressure switch which is closed when the movement of the craft is below a predetermined value connected to energize the signal when the pressure switch is closed. The steps comprise measuring the speed of the craft through the water via the pressure conditions of the fluid in the inlet tube and visually warning boats in the vicinity by energizing the visual signal responsive to the speed of the craft being less than a predetermined value.

12 Claims, 2 Drawing Sheets

METHOD AND APPARATUS FOR WARNING OTHER BOATS IN THE PROXIMITY OF A WATER CRAFT FOR TOWING WATER SKIERS AND OTHER PERSONS TO BE TOWED THAT THE WATER SKIER IS DOWN OR THE PERSON IS INACTIVE IN THE WATER

BACKGROUND OF THE INVENTION

This invention relates to safety devices for water skiers, tubers, and others being towed to help ensure that other water craft are apprised of their presence and do not collide with and injure them.

As is well known, water skiers and tubers, when in a relatively stationary position in the water, are in a vulnerable condition, and there have been a number of serious injuries when other water craft have, without being aware of their presence, run them down. Such injuries have proven particularly serious when the propellers of the water craft have contacted the bodies of the skiers or water tubers.

SUMMARY OF THE INVENTION

The present invention contemplates the provision of a highly visible, high intensity signal mounted on the towing boat which is responsive automatically to the speed of the boat and a pressure sensitive system which measures the fluid pressure in an inlet tube created by movement of the craft through the water. The system is adapted to be automatically activated by a pressure switch when the pressure falls below a predetermined value, such as when the craft is dead in the water, or virtually so, and the skier or tuber being towed is virtually in a stationary position in the water. The system is designed such that the visible signal is automatically extinguished when the boat again attains planing speed. More specifically, the invention contemplates the use of a strobe signal which provides one mile of visibility in daylight and flashes every three and one-half seconds, while being visible from substantially 360 degrees.

The method involves measuring the speed of the craft through the water via the pressure of the fluid in an inlet tube which is in communication with the water, energizing the visual strobe signal responsive to the speed of the craft being less than a predetermined value, and electrically visually warning boats in the vicinity when the towing boat is below planing speed. Thereafter, the continuing measurement of the speed of the craft through the water automatically results in the de-energization of the signal due to the pressure of the fluid in the inlet tube reaching a predetermined higher value.

One of the prime objects of the present invention is to provide a highly visual, high intensity, flashing signal which is disposed in a position to automatically alert all other boaters in the area to the fact that the skier is down or the tuber is no longer being towed.

A further object of the invention is to automatically de-energize the visual signal when the water sports rider is being towed again at speed.

A further object of the invention is to provide a system for warning other boats which greatly promotes water sports safety and is visible to other boats through substantially a visual orbit of 360 degrees.

Still another object of the invention is to design a warning system of highly reliable and economic character which is simple and, therefore, relatively trouble free.

A further object of the invention is to design a readily demountable visual signal system which can be easily removed from an already existing deck socket for easy stowing.

Other objects and advantages of the invention will become apparent with reference to the accompanying drawings and the accompanying descriptive matter.

GENERAL DESCRIPTION

Figure 1:
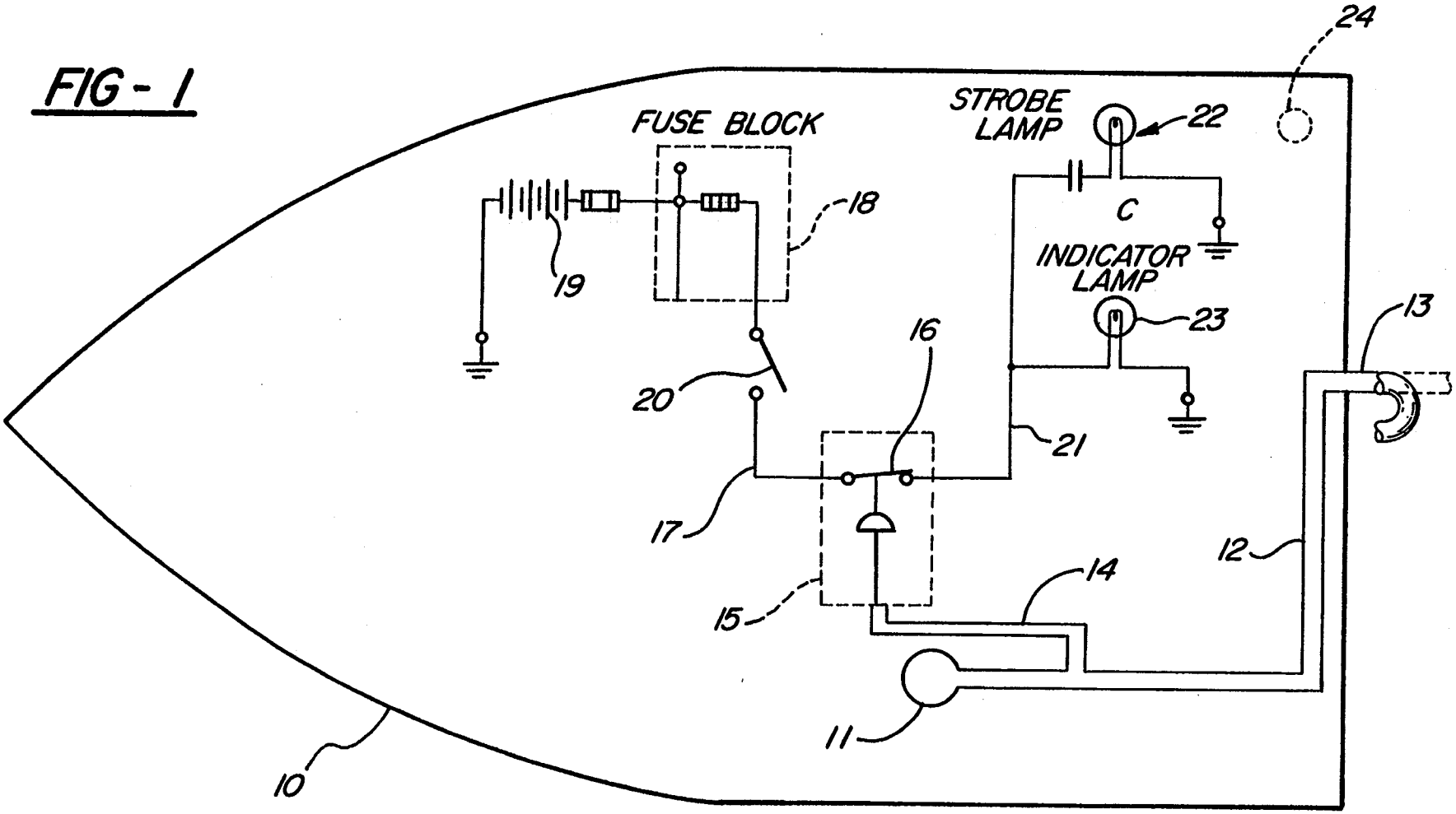
FIG. 1 is a schematic, electrical control diagram illustrating one form of the present invention.

Referring now more particularly in the first instance to FIG. 1, a water craft 10 is shown as having a pressure sensitive speedometer 11 situated on the dashboard or instrument panel of the craft in the usual manner. Typically, such a speedometer system includes an inlet pitot tube 12 having an intake portion 13 which projects into the water below the vessel's water line aft of the vessel and adjacent the transom. Normally, pressure sensing devices within the speedometer 11 are connected to an analog or digital indicator in the speedometer which provides an indication of boat speed. Dependent upon the speed of the vessel through the water, the hydrodynamic pressure rises from a hydrostatic pressure, when the vessel is dead in the water, to a higher value reflecting the hydrodynamic pressure exerted by the movement of the craft through the water.

Connected to the pressure tube 12 in parallel with the speedometer 11, is a tube 14 connecting with a normally closed pressure switch 15 of the character disclosed in the present assignee's U.S. Pat. No. 5,003,906. The switch 15, as in that patent, is openable in response to fluid pressure in the tube 14 when the vessel 10 attains planing speed. As mentioned in U.S. Pat. No. 5,003,906, utilizable pressure switches which can be adapted for use with the present invention are commercially available and one source for such switches is World Magnetics of Traverse City, Mich.

Provided within pressure switch 15, are the normally closed switch contacts 16, connecting in a first electrical path with circuit line 17 leading to an electrical system 18, which comprises a fuse block connected with a grounded battery system 19. An on-off switch 20 is provided in the circuit line 17 and may comprise a simple toggle switch, located on the dashboard of the vessel within easy reach of the boat operator. It is to be understood that the switch 20, when activated to closed position, in effect, activates the system for automatic operation and is a switch which would be closed at the outset of any towing operation.

A second electrical path or circuit line 21 leads from the switch 16 to a grounded strobe lamp or lighthead generally designated 22 to be more particularly described presently. The strobe lamp 22 is connected in parallel with a grounded indicator light 23 provided on the instrument panel so that the boat operator, without turning to constantly check the strobe lamp 22, may be assured that the strobe lamp is operative during appropriate time intervals when the skier or tuber is virtually stationary in the water and the vessel 10 is no longer at planing speed. The lamp 23 is, of course, preferably an LED-type lamp and is visible only to the boat operator. While the strobe lamp 22 flashes and is not energized during three and one-half second intervals, the lamp 23 is a constantly energized lamp to which the boat operator may refer.

Figure 2:
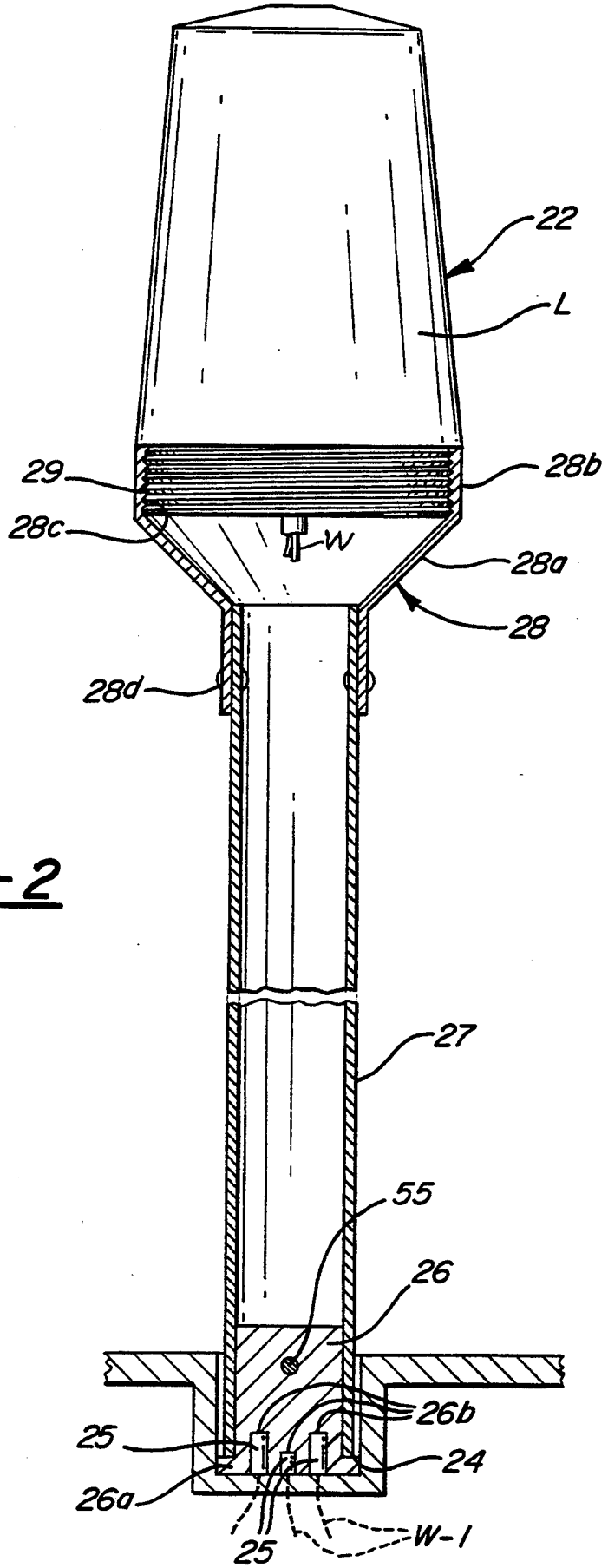
FIG. 2 is a sectional elevational view of the strobe signal showing it mounted in a stern deck socket on the boat.

With reference to FIG. 2, the boat 10 is shown as having the usual socket well 24 with the three socket prongs 25 which are connected in the electrical path 21. The socket typically used is the one usually provided on the stern end of the boat adjacent to the transom, or on the transom. In this position, the flashing lamp 22 can be readily seen, particularly by other water craft aft of the towing boat. Provided to fit within the well 24 is a coupler plug 26 having a peripheral flange **26*a* and sockets 26*b* for receiving the three prongs 25. The coupler plug 26 telescopically receives a lamp support tube 27 which may secure to it by way of a set screw SS, or in any other acceptable manner. Wires W lead from the base of the strobe lighthead 22 to the plug 26. Wires W-1, one of which is a ground wire, lead from the prongs 25** to connect with the electrical system.

At its upper end, the elongate tube 27 is telescopically received within a lamp support base, generally designated 28, having a divergent wall **28*a* terminating in a vertically extending flange wall 28*b* which may be riveted to the tube 27 as at 28*d*. The wall 28*b* is preferably internally threaded as at 28*c* to receive the strobe lighthead 22, which incorporates a 360 degree lens, and is externally threaded as at 29 to be received by the base threads 28*c***.

The strobe lamp 22 is one preferably having a replaceable plug-in lamp element L which is commercially available and may be obtained from Tomar Electronics of Gilbert, Ariz. It has been estimated that for a viewing distance of 330 feet, which is minimum for the present distance which contemplates one mile of visibility, an intensity of 200 candela is necessary under daytime conditions. The lighthead 22 chosen will have the desired intensity. While normally the capacitor c for energizing the strobe lamp element L is mounted within the base of the lighthead 22, it may be alternatively contained in a separate power box, mounted on the transom of the boat, and employ a larger higher capacity capacitor. The lamp element L preferably will be amber colored and will flash on and off at three and one-half second intervals. Tube 27 will be of sufficient vertical height above the outline of the towing craft that the strobe lamp 22 is visible from substantially 360 degrees, or at least a minimum of 280 degrees from the rear and sides. When not in use, the tube 27 with the attached lamp or lighthead 22 and coupler plug 26, may be removed from the socket well 24 and stowed.

THE OPERATION

In practice, to ready the system for operation, the boat operator closes the toggle switch 20 at the commencement of the towing activity. The switch contacts 16 are open and the strobe lamp 22 is operative when the skier or tuber is in the water ready to commence the towing operation. At this time, the water pressure in line 14 will be such that the switch contacts 16 remain closed. It is only when the boat attains a predetermined planing speed, such as perhaps ten knots, that the switch contacts 16 open and the strobe lamp 22, along with indicator lamp 23, are de-energized. When the vessel falls off planing speed, as when the operator is aware that the skier is down, or wishes not to be further towed, the hydrodynamic pressure exerted by movement of the watercraft through the ambient water decreases and the pressure switch 15 snaps back to its closed position so that both strobe lamp 22 and indicator lamp 23 are energized. With the vessel virtually having little or no speed, the hydrostatic pressure delivered is not sufficient to open switch 15 and it is only when planing speed is again attained by the towing vessel that the pressure switch 15 is opened by the predetermined hydrodynamic pressure once again.

Plainly, during the whole time period of the water sports activity which may, for instance, continue for most of a morning or afternoon, or perhaps for longer, the system will operate automatically in the manner described.

As indicated in the patent which I have incorporated herein, the intake end 13 may be curved or alternatively may extend linearly aft as indicated by the phantom lines. When the intake end extends in the phantom configuration it will be a negative pressure which is received by the intake end 23 and the pressure switch 15 may then be configured to operate by sensing negative pressure via reversal of the appropriate connections.

Further, as noted in the patent disclosed, it may be that the intake end 13 is not reversed in the water, but simply is exposed to ambient air which will operate the pressure switch in the same manner. Typically, however, the intake end will be located approximately two to four inches below the water line and the pressure switch 15 will be activated to open when a pressure of about three psi communicates with its diaphragm.

It is to be understood that the embodiments described are exemplary of various forms of the invention only and that the invention is defined in the appended claims which contemplate various modifications within the spirit and scope of the invention.

I claim:

1. A method of warning boats in the proximity of a towing water craft for water skiers, and other persons being towed in the water that the water skier or other person is down or inactive in the water via an electrically activated strobe light signal mounted to be visual to boats in the vicinity which is connected to the electrical system for energizing the craft and to a pressure sensitive element including a fluid inlet tube, the element being responsive to a fluid pressure condition in the inlet tube created by movement of the craft through the water, and there being a pressure switch which is closed when the pressure condition is at a predetermined value, connected to energize the strobe light signal when the pressure switch is closed, the steps of:

(a) measuring the speed of the craft through the water via the pressure condition of the fluid in the inlet tube;

(b) visually warning boats in the vicinity by energizing the strobe light visual signal responsive to the speed of the craft falling off to less than a predetermined value and changing the pressure condition in said inlet tube; and (c) automatically deenergizing the strobe light visual signal by returning the pressure condition switch to open position responsive to an increase in the speed of the boat.

2. The method of claim 1 wherein the electrical system includes a manually operated on-off switch, and said on-off switch is first of all activated to "on" position to ready the strobe light signal for operation.

3. The method of claim 1 wherein the visual signal is disposed sufficiently above the vessel outline to provide near a 360 degree range of visibility.

4. The method of claim 1 wherein the visual signal is disposed at the stern of the craft to provide a minimum 280 degree range of visibility.

5. A system for warning boats in the proximity of a towing water craft that the water skier or person is inactive in the water comprising:

a) an electrically activated high visibility warning light signal mounted on the craft to be visual to boats in the vicinity;

b) an electrical system including a signal circuit;

c) a pressure condition sensing element including an inlet tube, the element being sensitive to the pressure condition of fluid in the inlet tube created by movement of the craft through the water;

d) a pressure switch incorporated with said element which is closed under the existing pressure condition when the speed of the craft through the water is below a predetermined value, connected in said signal circuit to energize the warning light signal when the pressure switch is closed and to automatically open responsive to a changed pressure condition in said element and deenergize the warning light signal when the watercraft resumes a predetermined speed; and (e) a manually operable on-off switch in said electrical system for activating and deactivating said signal circuit.

6. The warning system of claim 5 wherein an indicator lamp is connected in said signal circuit to indicate when the on-off switch is in "on" position.

7. The system of claim 5 wherein the visual signal is disposed sufficiently above the vessel outline to provide near a 360 degree range of visibility.

8. The system of claim 5 wherein the visual signal is disposed at the stern of the craft to provide a minimum 280 degree range of visibility.

9. The system of claim 5 wherein said warning signal is a capacitor activated strobe lamp.

10. The system of claim 9 wherein a pole mounts said strobe lamp in an elevated position, the craft having a socket well with terminals, and said pole having sockets in its base end receiving said electrical terminals.

11. The system of claim 10 wherein said socket well is disposed in a wall at the stern end of the craft.

12. The system of claim 10 wherein said element connects with and operates a speedometer.

* * * * *